United States Patent [19]

Leger

[11] Patent Number: 4,950,375

[45] Date of Patent: Aug. 21, 1990

[54] DIE FOR ELECTROFORMING A PART

[75] Inventor: Donald F. Leger, Springfield, Mass.

[73] Assignee: United Technologies Corporation, Hartford, Conn.

[21] Appl. No.: 358,292

[22] Filed: May 26, 1989

[51] Int. Cl.[5] ..... C25D 1/10; C25D 21/12; C25D 1/00

[52] U.S. Cl. ..... 204/224 R; 204/228; 204/281; 204/DIG. 7

[58] Field of Search ..... 204/224 R, 281, DIG. 7, 204/228

[56] References Cited

U.S. PATENT DOCUMENTS

| | | | |
|---|---|---|---|
| 695,635 | 3/1902 | Emerson | 204/281 X |
| 1,335,176 | 3/1920 | Merritt | 204/DIG. 7 |
| 1,798,391 | 3/1931 | Würth | 204/DIG. 7 |
| 2,011,885 | 8/1935 | Young | 204/281 |
| 2,500,206 | 3/1950 | Schaefer et al. | 204/DIG. 7 |
| 3,092,558 | 6/1963 | Hughes et al. | 204/4 |

*Primary Examiner*—Donald R. Valentine

[57] ABSTRACT

A die for electroforming a nickel sheath thereon is provided with a groove filled with a non-conductive material at the desired dimension of the sheath. The die has an exposed portion beyond the dimensions of the sheath.

6 Claims, 1 Drawing Sheet

DIE FOR ELECTROFORMING A PART

TECHNICAL FIELD

This invention relates to an apparatus for electroforming a nickel sheath.

BACKGROUND ART

The leading edge of propeller blade requires protection from erosion, lightning and foreign objects. A nickel sheath is disposed upon the leading edge of the blade to provide such protection. The nickel sheath is also designed to withstand normal bending moments experienced by the propeller blade.

The nickel sheath is typically constructed by electroforming nickel particles upon a titanium die the blade. Nickel in solution is deposited on the die, which acts as a cathode, to form the sheath.

Portions of the external surface of the die are covered with a fiberglass casing. The casing ensures that the sheath is electroformed on the uncovered external surface of the die as desired. A portion of the external surface of the die beyond the desired blueprint dimension of the sheath is left uncased.

A line corresponding to the desired dimension of the sheath is scribed within the uncovered external surface of the die. The line is known to leave an imprint within the nickel electroformed thereover. The die is then deposited in a nickel bath, subjected to electric current to electroform the nickel sheath thereupon, and then removed from the bath. The sheath is removed from the die and machined to the scribe line.

DISCLOSURE OF THE INVENTION

It is an object of the invention to electroform a nickel sheath with a minimum of machining.

It is a further object of the invention to electroform a nickel sheath with a minimum of damage to the sheath.

According to the invention, a die for electroforming a nickel sheath thereon is provided with a groove filled with a non-conductive material at the desired dimension of the sheath. The die has an exposed portion beyond the dimensions of the sheath. The exposed portion acts as a thief for high current densities occurring at the edge of the desired dimension of the sheath so that any abnormal deposits of nickel during electroforming occur away from the part.

According to a feature of the invention, the groove is discontinuous to allow for easy removal of the sheath from the die.

These and other objects, features and advantages of the present invention will become more apparent in light of the following detailed description of a best mode embodiment thereof, as illustrated in the accompanying drawings.

BEST MODE FOR CARRYING OUT THE INVENTION

Figure 1:
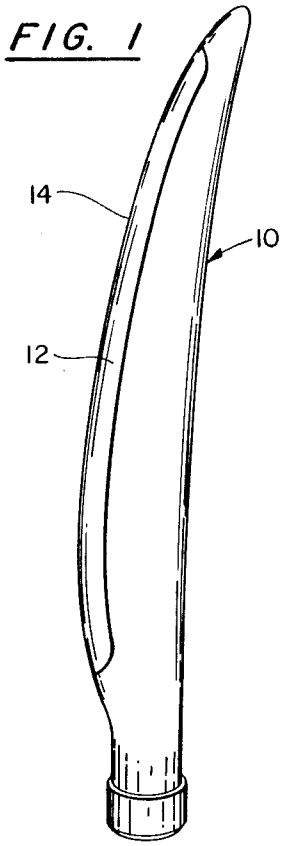
FIG. 1 is a perspective view of a propeller blade employing a sheath constructed using the concepts of the invention.

Referring to FIG. 1, a propeller blade 10, which utilizes a nickel sheath 12, which is formed by utilizing the concepts of the invention, is shown. Nickel sheaths are well known to provide erosion and foreign object damage (FOD) protection to the leading edge 14 of the blade, and to withstand the bending moments normally encountered by propeller blades.

Figure 2:
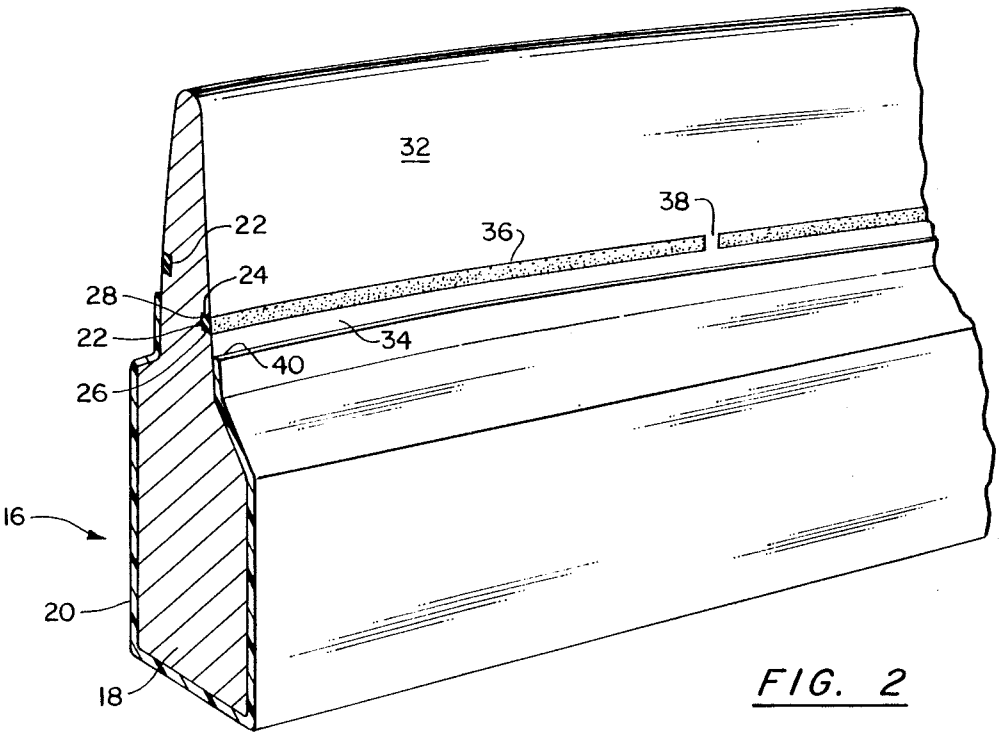
FIG. 2 is a die embodying the concepts of the invention.

Referring to FIG. 2, a die 16 for constructing the nickel sheath 12 of FIG. 1 is shown. The die 16, which acts as a cathode, is constructed of titanium. It is well known that nickel does not generally adhere to titanium during electroforming. A non-plating area 18 of the die is covered by a fiberglass casing 20.

A groove 22 having an upper side portion 24, a lower side portion 26, and a bottom portion 28 is machined into the die 16. The upper side portion 24 of the groove 22 defines the blueprint dimension of the sheath 12 on the surface of the die. The groove 22 is 0.060 inches deep and 0.075 inches wide. As one of ordinary skill will readily appreciate from the teachings herein, the width and depth of the groove 22 may be varied depending on the desired profile of the sheath. The groove 22 separates a forming area 32 on the surface of the die 16 above the groove and a "thief" area 34 on the surface of the die 16 below the groove 22 as will be discussed infra.

The groove 22 is filled with a non-conductive, temperature resistant epoxy 36 having minimal water absorption. The epoxy 16 is cast in place within the groove 22 and is finished to conform to the surface of the die 16. By finishing the epoxy 36 in this manner, any epoxy, which may have been deposited on the forming area 32 of the die 16, is removed. An epoxy, such as Stycast 2651 manufactured by Emerson and Cumming, Inc., of Woburn, Mass. is preferred. Such an epoxy provides for minimal water absorption (less than ½ of 1 percent) and withstands the temperatures encountered during electroforming. Because the epoxy 36 is non-conductive, nickel is not generally deposited thereon.

A discontinuous area 38 interrupts the groove 22. The area 38 allows for the removal of the sheath 12 from the die 16. A tool (not shown) may be inserted between the sheath 12 and the die 16 at the discontinuous area 38 to remove the die 16. A small amount of machining is required to bring the sheath 12 to the blueprint dimension because nickel is deposited over the area 38. The discontinuous area 38 allows for the relatively easy removal of the sheath 12 from the die 16 and minimizes damage to the sheath 12 during such removal.

To fabricate the sheath 12, a fiberglass shield 20 is connected about the die 16 by typical means such as bolts (not shown). The shield 20, as is known in the art, helps control the current densities upon the exterior surfaces 32, 34 of the die 16 so that nickel is deposited properly thereon to fit the required profile of the sheath 12. The die 16 is immersed in a nickel solution bath and subjected to an electric current for about seven hours (depending on the applied current) at about 130° F. during which time the nickel sheath 12 forms upon the die 16.

High current densities are known to form on the exterior surfaces 32, 34 of the die 16 at interfaces, such as the interface 40 between the shield 20 and the thief area 34. The high current densities cause nickel deposits to form on the die 16 which do not fit the desired profile of the sheath 12. If the shield 20 is positioned at the blueprint dimension of the sheath 12, excessive machining and part defects may occur. As a result, the shield 20 is placed in the thief area 34 of the die 16. The thief area 34 draws the relatively high current densities that would otherwise form at the interface between the upper side portion 24 of the groove 22 and the sheath 12 area. An excess buildup of material at the blueprint dimension of the part is avoided thereby. The placement of the shield 20 is chosen as a function of the desired profile of the sheath 12.

Although the invention has been shown and described with respect to a best mode embodiment thereof, it should be understood by those skilled in the art that the foregoing and various other changes, omissions, and additions in the form and detail thereof may be made without departing from the spirit and scope of the invention.

Having thus described the invention, what is claimed is:

1. A die, for electroforming a part, comprising:

a first, electrically conductive, exterior surface, having a shape conforming to an interior portion of the part;

an electrically non-conductive strip, having a first edge disposed adjacently to an edge of said first surface; and a second, electrically conductive, exterior surface, electrically connected to said first surface and having an edge disposed adjacently to a second edge of said strip; whereby applying current to the die causes said second surface to thieve current which would otherwise exist at the edge of said first surface.

2. A die, for electroforming a part, according to claim 1, wherein said strip is flush with said first and second surfaces.

3. A die, for electroforming a part, according to claim 2, wherein said first surface has a shape conforming generally to the shape of a nickel sheath for a propeller blade.

4. A die, for electroforming a part, according to claim 3, wherein said non-conductive strip is comprised of an epoxy material.

5. A die, for electroforming a part, according to claim 1, wherein said non-conductive strip is comprised of an epoxy material.

6. A die, for electroforming a part, according to claim 2, wherein said non-conductive strip is comprised of an epoxy material.

* * * * *